US011686186B1

(12) United States Patent
Publes et al.

(10) Patent No.: US 11,686,186 B1
(45) Date of Patent: Jun. 27, 2023

(54) CONTROLLING A POWER DEMAND OF A HYDRAULIC FRACTURING SYSTEM

(71) Applicant: Caterpillar Inc., Peoria, IL (US)

(72) Inventors: Andy Publes, Katy, TX (US); Mark Francis Grimes, Cypress, TX (US); Todd Ryan Kabrich, Tomball, TX (US); Mark C. Paul, Carmel, IN (US); Riadh Benguedda, Cypress, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/649,528

(22) Filed: Jan. 31, 2022

(51) Int. Cl.

| | |
|---|---|
| ***E21B 43/26*** | (2006.01) |
| ***E21B 41/00*** | (2006.01) |
| ***F04B 49/06*** | (2006.01) |
| ***F04B 49/20*** | (2006.01) |
| ***F04B 17/03*** | (2006.01) |

(52) U.S. Cl.
CPC ..... *E21B 43/26* (2013.01); *E21B 41/0085* (2013.01); *E21B 43/2607* (2020.05); *F04B 17/03* (2013.01); *F04B 49/06* (2013.01); *F04B 49/20* (2013.01)

(58) Field of Classification Search
CPC .. E21B 43/26; E21B 41/0085; E21B 43/2607; F04B 17/03; F04B 49/06; F04B 49/20
See application file for complete search history.

(56) References Cited

U.S. PATENT DOCUMENTS

| | | | | |
|---|---|---|---|---|
| 10,491,004 | B2 * | 11/2019 | Gerdes | H02J 3/381 |
| 10,815,764 | B1 * | 10/2020 | Yeung | F04B 51/00 |
| 11,114,857 | B2 | 9/2021 | Hinderliter et al. | |
| 11,415,125 | B2 * | 8/2022 | Yeung | E21B 43/2607 |
| 2016/0105022 | A1 * | 4/2016 | Oehring | E21B 43/2607 307/29 |
| 2019/0383123 | A1 | 12/2019 | Hinderliter | |
| 2020/0109617 | A1 * | 4/2020 | Oehring | F04B 23/06 |
| 2021/0025382 | A1 * | 1/2021 | Harvell | H02J 13/00004 |
| 2021/0032961 | A1 * | 2/2021 | Hinderliter | E21B 41/0085 |
| 2021/0108489 | A1 * | 4/2021 | Shampine | E21B 41/0085 |
| 2021/0246968 | A1 * | 8/2021 | Buckley | F04B 17/03 |
| 2021/0310320 | A1 * | 10/2021 | Fischer | F04D 13/068 |
| 2022/0127943 | A1 * | 4/2022 | El Tawy | H02P 29/50 |
| 2022/0282606 | A1 * | 9/2022 | Zhong | G01V 99/005 |
| 2022/0298906 | A1 * | 9/2022 | Zhong | E21B 43/2607 |

* cited by examiner

*Primary Examiner* — James G Sayre
(74) *Attorney, Agent, or Firm* — Harrity & Harrity, LLP

(57) ABSTRACT

In some implementations, a controller may monitor an available power supply of at least one power source for a system for hydraulic fracturing, and a current power demand of the system. The controller may determine, based on monitoring the available power supply and the current power demand, whether a relationship between the current power demand and the available power supply is indicative of an impending power failure. The controller may cause, based on determining that the relationship between the current power demand and the available power supply indicates the impending power failure, reduction of flow rates of one or more fluid pumps of the system to reduce the current power demand.

20 Claims, 3 Drawing Sheets

CONTROLLING A POWER DEMAND OF A HYDRAULIC FRACTURING SYSTEM

TECHNICAL FIELD

The present disclosure relates generally to hydraulic fracturing systems and, for example, to controlling a power demand of a hydraulic fracturing system.

BACKGROUND

Hydraulic fracturing is a well stimulation technique that typically involves pumping hydraulic fracturing fluid into a wellbore (e.g., using one or more well stimulation pumps) at a rate and a pressure (e.g., up to 15,000 pounds per square inch) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids.

A hydraulic fracturing system may include one or more power sources for providing power to components (e.g., the pumps) of the hydraulic fracturing system. The hydraulic fracturing system may employ a power control system that manages the power sources and ensures that adequate power for well stimulation is provided. For example, the power control system may attempt to match a power demand of the hydraulic fracturing system with a power supply from the power sources, with the goal of minimizing the number of power sources that are active at any given time. However, such a power control system may not be suitable for handling dynamic conditions, such as the sudden failure of a power source or an unexpected increase in power demand. Here, if the power demand exceeds the power supply, the power sources will become overloaded, which may lead to a power failure (e.g., a blackout). As a result of the power failure, pressure and fluid flow may be lost at the well. This type of uncontrolled shutdown may damage the hydraulic fracturing system, damage the well, or the like.

To avoid an uncontrolled shutdown caused by power failure, some hydraulic fracturing systems may include one or more auxiliary power sources (e.g., auxiliary generator sets or energy storage units). The auxiliary power sources may operate constantly during operation of a hydraulic fracturing system, but without contributing to the overall power supply of the hydraulic fracturing system except at times when power demand exceeds power supply. Accordingly, use of auxiliary power sources wastes fuel resources, increases emissions of the hydraulic fracturing system, and increases wear on equipment of the auxiliary power sources.

The control system of the present disclosure solves one or more of the problems set forth above and/or other problems in the art.

SUMMARY

In some implementations, a system for hydraulic fracturing includes a plurality of power sources that include at least one active power source and at least one inactive power source; a fluid pump; a motor configured to drive the fluid pump; a variable frequency drive (VFD) configured to control the motor; and a controller configured to: monitor an available power supply from the at least one active power source, and a current power demand of the system; determine, based on monitoring the available power supply and the current power demand, whether a relationship between the current power demand and the available power supply is indicative of an impending power failure; determine, based on determining that the relationship between the current power demand and the available power supply indicates the impending power failure, an adjustment to a speed of the motor that achieves a minimum reduction of the current power demand that avoids the impending power failure; cause, via the VFD, reduction of the speed of the motor in accordance with the adjustment to achieve the minimum reduction of the current power demand; and cause activation of the at least one inactive power source to increase the available power supply.

In some implementations, a method includes monitoring an available power supply of at least one power source for a system for hydraulic fracturing, and a current power demand of the system; determining, based on monitoring the available power supply and the current power demand, whether a relationship between the current power demand and the available power supply is indicative of an impending power failure; and causing, based on determining that the relationship between the current power demand and the available power supply indicates the impending power failure, reduction of flow rates of one or more fluid pumps of the system to reduce the current power demand.

In some implementations, a controller includes one or more memories and one or more processors configured to: monitor an available power supply of at least one power source for a system for hydraulic fracturing, and a current power demand of the system; and control, based on the current power demand corresponding to the available power supply, flow rates of one or more fluid pumps of the system to maintain the current power demand at or below the available power supply.

DETAILED DESCRIPTION

Figure 1:
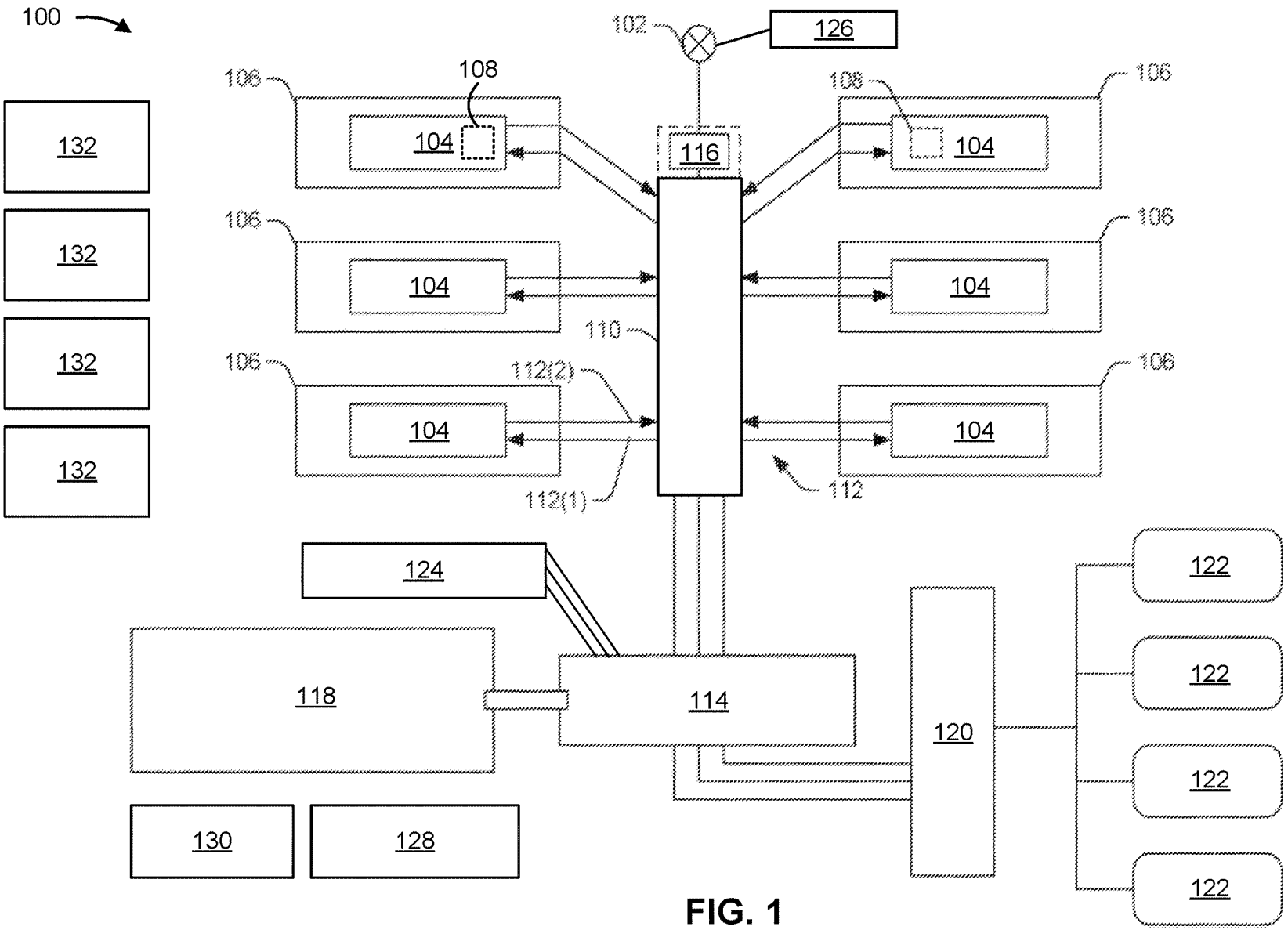
FIG. 1 is a diagram illustrating an example hydraulic fracturing system.

FIG. 1 is a diagram illustrating an example hydraulic fracturing system 100. For example, FIG. 1 depicts a plan view of an example hydraulic fracturing site along with equipment that is used during a hydraulic fracturing process. In some examples, less equipment, additional equipment, or alternative equipment to the example equipment depicted in FIG. 1 may be used to conduct the hydraulic fracturing process.

The hydraulic fracturing system 100 includes a well 102. As described previously, hydraulic fracturing is a well-stimulation technique that uses high-pressure injection of fracturing fluid into the well 102 and corresponding wellbore in order to hydraulically fracture a rock formation surrounding the wellbore. While the description provided herein describes hydraulic fracturing in the context of wellbore stimulation for oil and gas production, the description herein is also applicable to other uses of hydraulic fracturing.

High-pressure injection of the fracturing fluid may be achieved by one or more pump systems 104 that may be mounted (or housed) on one or more hydraulic fracturing trailers 106 (which also may be referred to as "hydraulic fracturing rigs") of the hydraulic fracturing system 100. Each of the pump systems 104 includes at least one fluid pump 108 (referred to herein collectively, as "fluid pumps 108" and individually as "a fluid pump 108"). The fluid pumps 108 may be hydraulic fracturing pumps. The fluid pumps 108 may include various types of high-volume hydraulic fracturing pumps such as triplex or quintuplex pumps. Additionally, or alternatively, the fluid pumps 108 may include other types of reciprocating positive-displacement pumps or gear pumps. A type and/or a configuration of the fluid pumps 108 may vary depending on the fracture gradient of the rock formation that will be hydraulically fractured, the quantity of fluid pumps 108 used in the hydraulic fracturing system 100, the flow rate necessary to complete the hydraulic fracture, the pressure necessary to complete the hydraulic fracture, or the like. The hydraulic fracturing system 100 may include any number of trailers 106 having fluid pumps 108 thereon in order to pump hydraulic fracturing fluid at a predetermined rate and pressure.

In some examples, the fluid pumps 108 may be in fluid communication with a manifold 110 via various fluid conduits 112, such as flow lines, pipes, or other types of fluid conduits. The manifold 110 combines fracturing fluid received from the fluid pumps 108 prior to injecting the fracturing fluid into the well 102. The manifold 110 also distributes fracturing fluid to the fluid pumps 108 that the manifold 110 receives from a blender 114 of the hydraulic fracturing system 100. In some examples, the various fluids are transferred between the various components of the hydraulic fracturing system 100 via the fluid conduits 112. The fluid conduits 112 include low-pressure fluid conduits 112(1) and high-pressure fluid conduits 112(2). In some examples, the low-pressure fluid conduits 112(1) deliver fracturing fluid from the manifold 110 to the fluid pumps 108, and the high-pressure fluid conduits 112(2) transfer high-pressure fracturing fluid from the fluid pumps 108 to the manifold 110.

The manifold 110 also includes a fracturing head 116. The fracturing head 116 may be included on a same support structure as the manifold 110. The fracturing head 116 receives fracturing fluid from the manifold 110 and delivers the fracturing fluid to the well 102 (via a well head mounted on the well 102) during a hydraulic fracturing process. In some examples, the fracturing head 116 may be fluidly connected to multiple wells. The fluid pumps 108, the fluid conduits 112, the manifold 110, and/or the fracturing head 116 may define a fluid system of the hydraulic fracturing system 100. As described herein, a pressure test of the fluid system may be conducted to test an integrity of the fluid system.

The blender 114 combines proppant received from a proppant storage unit 118 with fluid received from a hydration unit 120 of the hydraulic fracturing system 100. In some examples, the proppant storage unit 118 may include a dump truck, a truck with a trailer, one or more silos, or other type of containers. The hydration unit 120 receives water from one or more water tanks 122. In some examples, the hydraulic fracturing system 100 may receive water from water pits, water trucks, water lines, and/or any other suitable source of water. The hydration unit 120 may include one or more tanks, pumps, gates, or the like.

The hydration unit 120 may add fluid additives, such as polymers or other chemical additives, to the water. Such additives may increase the viscosity of the fracturing fluid prior to mixing the fluid with proppant in the blender 114. The additives may also modify a pH of the fracturing fluid to an appropriate level for injection into a targeted formation surrounding the wellbore. Additionally, or alternatively, the hydraulic fracturing system 100 may include one or more fluid additive storage units 124 that store fluid additives. The fluid additive storage unit 124 may be in fluid communication with the hydration unit 120 and/or the blender 114 to add fluid additives to the fracturing fluid.

In some examples, the hydraulic fracturing system 100 may include a balancing pump 126. The balancing pump 126 provides balancing of a differential pressure in an annulus of the well 102. The hydraulic fracturing system 100 may include a data monitoring system 128. The data monitoring system 128 may manage and/or monitor the hydraulic fracturing process performed by the hydraulic fracturing system 100 and the equipment used in the process. In some examples, the management and/or monitoring operations may be performed from multiple locations. The data monitoring system 128 may be supported on a van, a truck, or may be otherwise mobile. The data monitoring system 128 may include a display for displaying data for monitoring performance and/or optimizing operation of the hydraulic fracturing system 100. In some examples, the data gathered by the data monitoring system 128 may be sent off-board or off-site for monitoring performance and/or performing calculations relative to the hydraulic fracturing system 100.

The hydraulic fracturing system 100 includes a controller 130. The controller 130 is in communication (e.g., by a wired connection or a wireless connection) with the pump systems 104 of the trailers 106. The controller 130 may also be in communication with other equipment and/or systems of the hydraulic fracturing system 100. The controller 130 may include one or more memories, one or more processors, and/or one or more communication components. The controller 130 (e.g., the one or more processors) may be configured to perform operations associated with controlling a power demand of the hydraulic fracturing system 100, as described in connection with FIG. 2.

The hydraulic fracturing system 100 may include one or more power sources 132. The power sources 132 may be in communication with the controller 130. For example, the controller 130 may control activation or deactivation of the power sources 132. Among other examples, the power sources 132 may include an electrical utility grid, an electrical microgrid, one or more turbines, one or more generator sets, one or more energy storage devices (e.g., batteries), one or more renewable energy systems (e.g., wind energy systems, solar energy systems, hydroelectric energy systems, or the like), or a combination thereof.

As indicated above, FIG. 1 is provided as an example. Other examples may differ from what is described with regard to FIG. 1.

Figure 2:
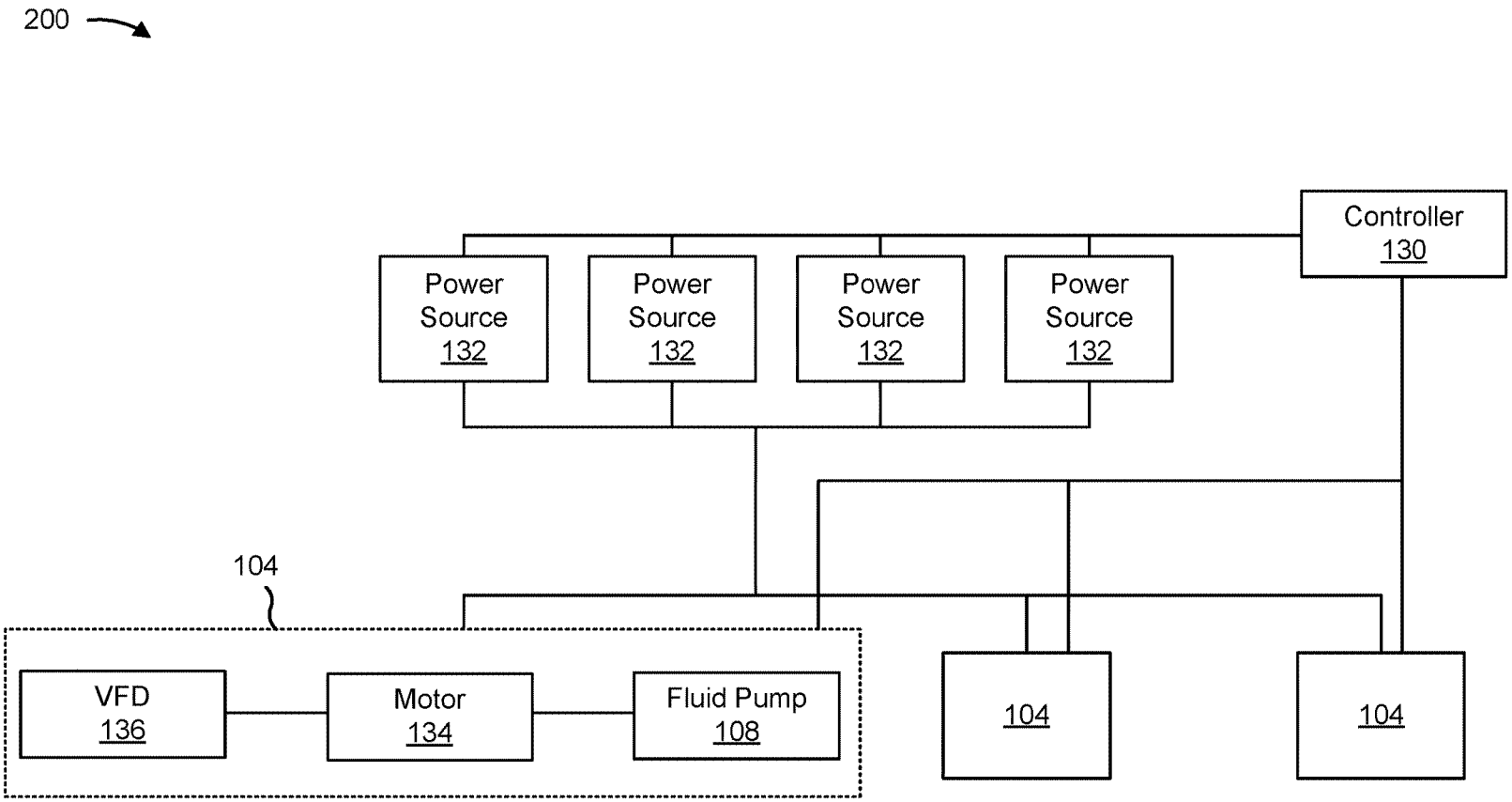
FIG. 2 is a diagram illustrating an example control system.

FIG. 2 is a diagram illustrating an example control system 200. The control system 200 may include one or more components of the hydraulic fracturing system 100, as described herein.

The control system 200 includes one or more pump systems 104. As described herein, pressurized fluid from each of the pump systems 104 may be combined at the manifold 110. Each pump system 104 includes a fluid pump 108, as described herein. Each pump system 104 also includes a motor 134 configured to drive (e.g., via a driveshaft) the fluid pump 108. The motor 134 may include an electric motor (e.g., an alternating current (AC) electric motor), such as an induction motor or a switched reluctance motor. In some examples, the fluid pump 108 and the motor 134 may share a housing. Each pump system 104 also includes a variable frequency drive (VFD) 136 that controls the motor 134. For example, the VFD 136 includes an electro-mechanical drive system configured to control a speed and/or a torque of the motor 134 by varying an input frequency and/or input voltage to the motor 134.

As shown in FIG. 2, the control system 200 includes one or more power sources 132. The power sources 132 may include one or more active power sources 132 and/or one or more inactive power sources 132. An active power source 132 may be online and generating, or otherwise contributing, electrical power. An inactive power source 132 may be offline and contributing no electrical power.

Power provided by the power sources 132 may be combined prior to distribution to other components that use electricity. The combined power of the power sources 132 (e.g., the active power sources 132) represents an available power supply of the hydraulic fracturing system 100. As shown, power provided by the power sources 132 may be distributed to the pump systems 104. Moreover, the blender 114, the hydration unit 120, the balancing pump 126, and/or the data monitoring system 128, among other examples, of the hydraulic fracturing system 100 may receive power from the power sources 132. During operation of the hydraulic fracturing system 100, power requirements for operating the pump systems 104 and other power-consuming components of the hydraulic fracturing system 100 (e.g., the blender 114, the hydration unit 120, the balancing pump 126, and/or the data monitoring system 128) represent a current (e.g., instantaneous) power demand or power load of the hydraulic fracturing system 100. In some implementations, the current power demand may include an amount of power associated with a commanded power increase (e.g., a commanded increase of a flow rate of the fluid pumps 108) that has yet to be carried out.

As shown in FIG. 2, the control system 200 includes the controller 130. The controller 130 may be configured to perform operations associated with controlling a power demand of the control system 200, the hydraulic fracturing system 100, or the like, as described herein. The controller 130 may be a local controller for a pump system 104 or a system-wide controller for a plurality of pump systems 104. The controller 130 may be in communication with the power sources 132 and the pump systems 104. For example, the controller 130 may transmit a signal to a power source 132 to cause activation of the power source 132. Moreover, the controller 130 may receive information from a power source 132 indicating whether the power source 132 is active. As another example, the controller 130 may transmit a signal to a pump system 104 (e.g., a VFD 136 of the pump system 104) to control a speed of a motor 134 of the pump system 104.

The controller 130 may obtain a setting for a flow rate from fluid pumps 108 of the pump systems 104. The setting for the flow rate may indicate a commanded flow rate for the fluid pumps 108. In some implementations, the controller 130 may obtain the setting for the flow rate from a local or a remote memory or other storage, from another device, or the like, in a similar manner as described above. Additionally, or alternatively, to obtain the setting for the flow rate, the controller 130 may receive an input (e.g., an operator input) that indicates the setting for the flow rate. The controller 130 obtaining the setting for the flow rate may trigger a ramp up of the fluid pumps 108, thereby increasing a power demand of the hydraulic fracturing system 100. The controller 130 may cause activation of one or more power sources 132 to meet the power demand.

The controller 130 may monitor (e.g., during operation of the hydraulic fracturing system 100) the available power supply from the power sources 132 (e.g., from the active power sources 132). For example, the controller 130 may monitor whether the power sources 132 are active or inactive, and the controller 130 may detect changes to the available power supply during operation of the hydraulic fracturing system 100 (e.g., in real time) due to inactivation or failure of a power source 132 and/or activation of a power source 132. In some examples, the controller 130 may determine the available power supply based on a configuration of active power sources 132 (e.g., at a given time) or based on a setting (e.g., an operator setting) for a power level limit. The controller 130 may monitor (e.g., during operation of the hydraulic fracturing system 100) a current power demand of the hydraulic fracturing system 100. During operation of the hydraulic fracturing system 100, the controller 130 may detect changes to the current power demand due to increases to the flow rate of the fluid pumps 108 and/or decreases to the flow rate of the fluid pumps 108.

The controller 130 may determine whether a relationship between the current power demand and the available power supply is indicative of an impending power failure. For example, the controller 130 may determine whether the relationship is indicative of the impending power failure based on monitoring the available power supply and the current power demand. The relationship between the current power demand and the available power supply may be expressed as a ratio of available power supply to current power demand. In some examples, the relationship between the current power demand and the available power supply is indicative of an impending power failure if the current power demand equals the available power supply (e.g., the ratio is 1:1), the current power demand exceeds the available power supply (e.g., the ratio is 1:>1), or the current power demand is within a threshold of the available power supply (e.g., the current power demand is greater than 80%, greater than 90%, greater than 95%, or the like, of the available power supply). The relationship between the current power demand and the available power supply may indicate an impending power failure due to a command to increase a flow rate of the fluid pumps 108 (e.g., an operator request to increase the flow rate by an amount that would result in power demand exceeding power supply) and/or an inactivation (e.g., a failure) or a derating of one or more power sources 132. In the event that the relationship between the current power demand and the available power supply is indicative of an impending power failure, the ratio of available power supply to current power demand may indicate (e.g., based on a difference between the ratio and a 1:1 ratio, or the like) a new flow rate for a fluid pump 108 and/or a motor speed reduction that is needed to avoid the impending power failure. As described herein, this facilitates a jump to the needed flow rate and/or motor speed rather than a ramp down of power demand, which may be too slow and lead to the power failure. Thus, the ratio of available power supply to current power demand may indicate a flow rate reduction and/or motor speed reduction (e.g., that achieves a minimum reduction of the current power demand that avoids the power failure).

The controller 130 may determine an adjustment to a speed of a motor 134 (e.g., respective adjustments for each of the motors 134), for a fluid pump 108, that reduces the current power demand. For example, the controller 130 may determine the adjustment based on the relationship between the current power demand and the available power supply indicating an impending power failure. In some implementations, the controller 130 may determine an adjustment to the speed of the motor 134 that achieves a minimum reduction of the current power demand that avoids the impending power failure.

The controller 130 may determine the minimum reduction of the current power demand based on a power difference (e.g., an absolute power difference or an absolute power difference plus-or-minus a tolerance) between the current power demand and the available power supply. Thus, the controller 130 may determine the adjustment to the speed of the motor 134 based on a motor speed that is associated with the power difference (e.g., a motor speed that would consume the power difference). Such a determination may also be based on a pressure of the hydraulic fracturing system 100, which may be constant in some cases. The controller 130 may determine the motor speed that is associated with the power difference based on a configuration of the pump system 104 (or a configuration of the hydraulic fracturing system 100, the control system 200, or the like). The configuration of the pump system 104 may include a gear ratio of the fluid pump 108 and/or motor 134, a stroke length of the fluid pump 108, a bore diameter (e.g., a plunger diameter) of the fluid pump 108, and/or a parasitic loss associated with the fluid pump 108, among other examples.

The controller 130 may control a flow rate of the fluid pumps 108 to maintain the current power demand at or below the available power supply. For example, the controller 130 may control the flow rate based on the current power demand corresponding to (e.g., equaling, exceeding, or being within a threshold of) the available power supply (e.g., based on the relationship between the current power demand and the available power supply indicating an impending power failure). To control the flow rate, the controller 130 may discard (e.g., ignore) a command to increase the flow rate that would result in the current power demand exceeding the available power supply. Alternatively, to control the flow rate, the controller 130 may execute the command to increase the flow rate (e.g., by causing adjustment to speeds of one or more motors 134) only up to a level that would result in the current power demand being at or below the available power supply. In such cases, the controller 130 may provide a notification (e.g., on an operator interface) indicating that the command was not executed or only partially executed.

Moreover, to control the flow rate, the controller 130 may cause reduction of flow rates of one or more pumps 108, thereby reducing the current power demand. For example, reduction of the flow rates may achieve a minimum reduction of the current power demand that avoids the impending power failure. In some examples, to reduce the flow rates, the controller 130 may cause reduction of speeds of motors 134 that respectively drive the pumps 108. In particular, the controller 130 may cause reduction of the speed of a motor 134 in accordance with the adjustment determined for the speed of the motor 134, as described herein. By reducing the speed of the motor 134 in accordance with the adjustment, the minimum reduction of the current power demand that avoids the impending power failure may be achieved. The minimum reduction may further ensure that, while avoiding the impending power failure, pressurization at the well 102 is maintained. When reducing the speed of the motor 134, the controller 130 may control a rate of change of the speed of the motor 134 for improved stabilization.

The controller 130 may cause reduction to the speed of a motor 134 via a VFD 136 (e.g., by communicating with a motor control processing unit of the VFD 136). For example, the controller 130 may set a torque setting (e.g., a torque target setting or a torque limit setting) or a speed setting (e.g., a speed target setting or a speed limit setting), in a control mode (e.g., a torque control mode or a speed control mode) for the VFD 136, to a reduced value (e.g., a value that is lower than a current operating torque or speed of the motor 134). In accordance with the torque setting or the speed setting being set to the reduced value, the VFD 136 may control the motor 134 by adjusting (e.g., reducing) the speed of the motor 134 to the reduced value. In other words, the controller 130 may cause reduction to the speed of the motor 134 by causing the VFD 136 to vary an input frequency and/or an input voltage to the motor 134.

The controller 130 may determine which fluid pumps 108 are to have reduced flow rates, and/or amounts of flow rate reduction for particular fluid pumps 108, according to one or more conditions. For example, the controller 130 may select one or more fluid pumps 108, from a plurality of fluid pumps 108, for flow rate reduction based on respective machine hour values of the plurality of fluid pumps 108. "Machine hour" may refer to a total amount of time a machine has operated over an entire lifespan of the machine. The controller 130 may select the one or more fluid pumps 108 associated with relatively higher machine hours for flow rate reduction, thereby decreasing the load on relatively older fluid pumps 108 and increasing the useful life of the fluid pumps 108.

In some examples, reduction of flow rates of one or more fluid pumps 108 may be in accordance with respective load distribution settings for the fluid pumps 108. For example, the control system 200 may have a configuration (e.g., provided by an operator) that indicates respective proportions of an overall load for each fluid pump 108. Thus, reduction of the flow rates may be in accordance with the configuration, so that the respective load proportions for each fluid pump 108 are the same before and after the flow rates are reduced. In some examples, the controller 130 may cause reduction of flow rates of multiple fluid pumps 108 in a particular sequence. The sequence may result in flow rates being reduced for one or more first fluid pumps 108 in a first time period and flow rates being reduced for one or more second fluid pumps 108 in a second time period. The sequence may be configured to maintain a stable fluid flow and pressure at the well head of the well 102.

The controller 130 may cause activation of at least one inactive power source 132. The controller 130 may cause activation of inactive power sources 132 following, or concurrently with, reducing flow rates of one or more fluid pumps 108. The controller 130 may cause activation of inactive power sources 132 based on the current power demand corresponding to the available power supply (e.g., based on the relationship between the current power demand and the available power supply indicating an impending power failure). The controller 130 may cause activation of inactive power sources 132 in addition to, or instead of, reducing a flow rate of a fluid pump 108. To cause activation of an inactive power source 132, the controller 130 may transmit an activation signal to the inactive power source 132. In some examples, an inactive power source 132 may be activated by another system or may be activated manually, and the controller 130 may detect the activation of the inactive power source 132.

Activating one or more inactive power sources 132 increases the available power supply. Thus, based on activation of at least one inactive power source 132, the controller 130 may cause increasing of flow rates of the one or more fluid pumps 108 for which flow rates were reduced. For example, the controller 130 may cause (e.g., via a VFD 136) increasing of the speed of a motor 134 to offset the adjustment to the speed of the motor 134. As another example, the controller 130 may cause increasing of the speed of a motor 134 to satisfy a previous command to increase flow rate that was discarded or only partially executed.

As indicated above, FIG. 2 is provided as an example. Other examples may differ from what is described with regard to FIG. 2.

Figure 3:
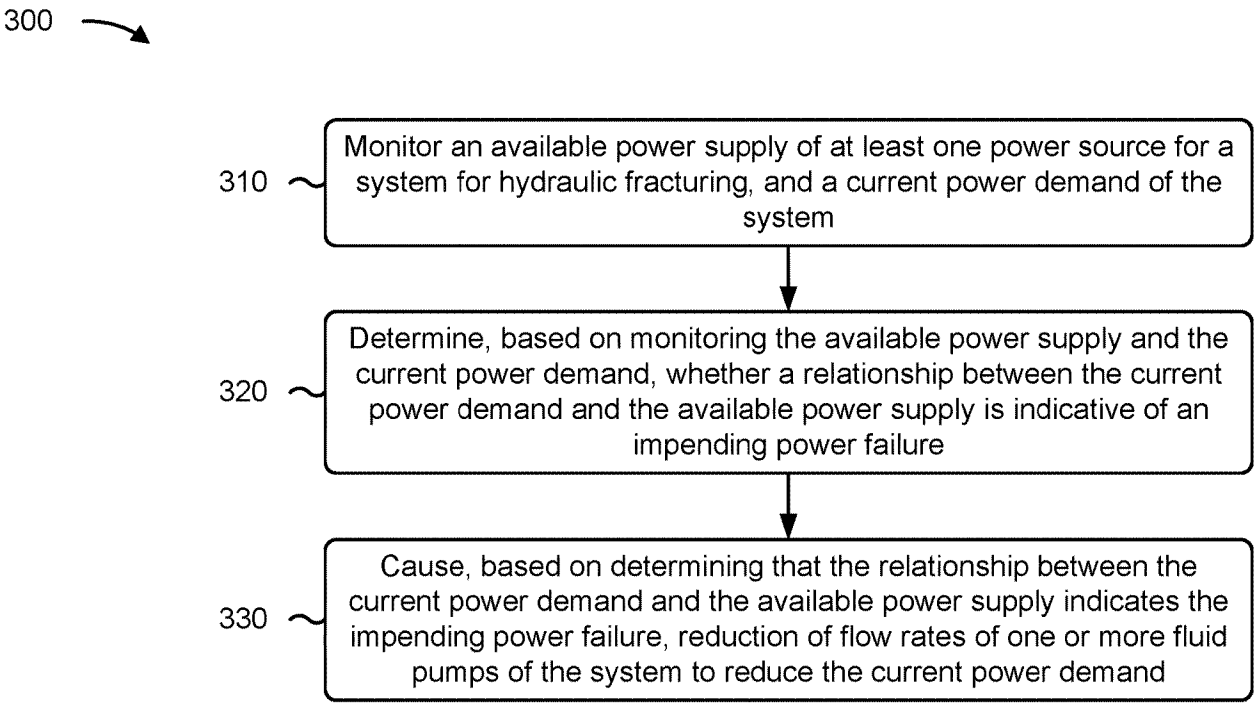
FIG. 3 is a flowchart of an example process relating to controlling a power demand of a hydraulic fracturing system.

FIG. 3 is a flowchart of an example process 300 associated with controlling a power demand of a hydraulic fracturing system. One or more process blocks of FIG. 3 may be performed by a controller (e.g., controller 130). Additionally, or alternatively, one or more process blocks of FIG. 3 may be performed by another device or a group of devices separate from or including the controller, such as another device or component that is internal or external to the hydraulic fracturing system 100. Additionally, or alternatively, one or more process blocks of FIG. 3 may be performed by one or more components of a device, such as a processor, a memory, an input component, an output component, and/or communication component.

As shown in FIG. 3, process 300 may include monitoring an available power supply of at least one power source for a system for hydraulic fracturing, and a current power demand of the system (block 310). For example, the controller (e.g., using a processor, a memory, a communication component, or the like) may monitor an available power supply of at least one power source for a system for hydraulic fracturing, and a current power demand of the system, as described above. Monitoring the available power supply may include monitoring whether the at least one power source is active or inactive.

As further shown in FIG. 3, process 300 may include determining, based on monitoring the available power supply and the current power demand, whether a relationship between the current power demand and the available power supply is indicative of an impending power failure (block 320). For example, the controller (e.g., using a processor, a memory, or the like) may determine, based on monitoring the available power supply and the current power demand, whether a relationship between the current power demand and the available power supply is indicative of an impending power failure, as described above.

A plurality of fluid pumps may includes the one or more fluid pumps, and the plurality of fluid pumps may be associated with respective machine hour values. Here, process 300 may further include selecting the one or more fluid pumps from the plurality of fluid pumps based on the respective machine hour values.

Process 300 may further include determining, based on determining that the relationship between the current power demand and the available power supply indicates the impending power failure, an adjustment to a speed of a motor that achieves a minimum reduction of the current power demand that avoids the impending power failure. Determining the adjustment may include determining the minimum reduction of the current power demand based on a power difference between the current power demand and the available power supply, and determining the adjustment to the speed of the motor based on a motor speed that is associated with the power difference.

As further shown in FIG. 3, process 300 may include causing, based on determining that the relationship between the current power demand and the available power supply indicates the impending power failure, reduction of flow rates of one or more fluid pumps of the system to reduce the current power demand (block 330). For example, the controller (e.g., using a processor, a memory, a communication component, or the like) may cause, based on determining that the relationship between the current power demand and the available power supply indicates the impending power failure, reduction of flow rates of one or more fluid pumps of the system to reduce the current power demand, as described above.

Causing reduction of the flow rates of the one or more fluid pumps may include causing, via the VFD, reduction of speeds of one or more motors. Moreover, causing reduction of the speed of a motor may include causing the VFD to vary at least one of an input frequency or an input voltage to the motor. For example, causing reduction of the speed of the motor may include setting a speed setting in a control mode for the VFD to a reduced speed value.

Reduction of the flow rates of the one or more fluid pumps may be caused in accordance with respective load distribution settings for the one or more fluid pumps. The flow rates of the one or more fluid pumps may be reduced in a particular sequence. Reduction of the flow rates of the one or more fluid pumps may achieve a minimum reduction of the current power demand that avoids the impending power failure.

The at least one power source may include at least one active power source and at least one inactive power source. Here, process 300 may further include causing, based on the current power demand corresponding to the available power supply, activation of the at least one inactive power source to increase the available power supply. Furthermore, process 300 may further include causing increasing of flow rates of the one or more fluid pumps based on the activation of the at least one inactive power source. For example, process 300 may further include causing (e.g., via a VFD) increasing of the speed of a motor to offset the adjustment based on activation of the at least one inactive power source Although FIG. 3 shows example blocks of process 300, in some implementations, process 300 may include additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

The control system described herein may be used with any hydraulic fracturing system that pressurizes hydraulic fracturing fluid using motor-driven pumps. For example, the control system may be used with a hydraulic fracturing system that pressurizes hydraulic fracturing fluid using a pump that is driven by a motor that is controlled by a VFD. The control system is useful for detecting an impending power failure (e.g., a blackout) of the hydraulic fracturing system, and for reducing the flow rate of one or more pumps based on detecting the impending power failure, thereby preventing the power failure and an ensuing uncontrolled shutdown of the hydraulic fracturing system. In particular, the control system may detect the impending power failure by monitoring a relationship between an available power supply from power sources for the hydraulic fracturing system and a current power demand of the hydraulic fracturing system, and the control system may automatically reduce the flow rate of one or more pumps if the impending power failure is detected, thereby reducing power demand. Moreover, the control system may reduce the flow rate of a pump by controlling a speed of a motor for the pump via a VFD. In this way, the control system may respond to the impending power failure with improved speed.

Thus, the control system provides improved control of a power demand of the hydraulic fracturing system and reduces a likelihood that a power failure will occur. Accordingly, the control system may prevent uncontrolled shutdown of the hydraulic fracturing system, thereby preventing damage to equipment of the hydraulic fracturing system, a well, or the like. Moreover, the control system improves an uptime of the hydraulic fracturing system.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, etc., depending on the context.

What is claimed is:

1. A system for hydraulic fracturing, comprising:

a plurality of power sources that include at least one active power source and at least one inactive power source;

a fluid pump;

a motor configured to drive the fluid pump;

a variable frequency drive (VFD) configured to control the motor; and a controller configured to:

monitor an available power supply from the at least one active power source, and a current power demand of the system;

determine, based on monitoring the available power supply and the current power demand, whether a relationship between the current power demand and the available power supply is indicative of an impending power failure;

determine, based on determining that the relationship between the current power demand and the available power supply indicates the impending power failure, an adjustment to a speed of the motor that achieves a minimum reduction of the current power demand that avoids the impending power failure;

cause, via the VFD, reduction of the speed of the motor in accordance with the adjustment to achieve the minimum reduction of the current power demand; and cause activation of the at least one inactive power source to increase the available power supply.

2. The system of claim 1, wherein the controller is further configured to:

cause, via the VFD, increasing of the speed of the motor to offset the adjustment based on activation of the at least one inactive power source.

3. The system of claim 1, wherein the controller, to determine the adjustment, is configured to:

determine the minimum reduction of the current power demand based on a power difference between the current power demand and the available power supply; and determine the adjustment to the speed of the motor based on a motor speed that is associated with the power difference.

4. The system of claim 1, wherein the relationship between the current power demand and the available power supply is indicative of the impending power failure if the current power demand equals the available power supply, exceeds the available power supply, or is within a threshold of the available power supply.

5. The system of claim 1, wherein the plurality of power sources include an electrical grid, one or more turbines, one or more generator sets, one or more energy storage devices, one or more renewable energy systems, or a combination thereof.

6. The system of claim 1, wherein the relationship between the current power demand and the available power supply is indicative of the impending power failure due to a command to increase a flow rate of the fluid pump or an inactivation or a derating of one or more of the plurality of power sources.

7. The system of claim 1, wherein the controller, to cause the reduction of the speed of the motor, is configured to:

set a speed setting in a control mode for the VFD to a reduced speed value.

8. The system of claim 1, wherein the controller, to cause the reduction of the speed of the motor, is configured to:

cause the VFD to vary at least one of an input frequency or an input voltage to the motor.

9. A method, comprising:

monitoring an available power supply of at least one power source for a system for hydraulic fracturing, and a current power demand of the system;

determining, based on monitoring the available power supply and the current power demand, whether a relationship between the current power demand and the available power supply is indicative of an impending power failure; and causing, based on determining that the relationship between the current power demand and the available power supply indicates the impending power failure, reduction of flow rates of one or more fluid pumps of the system to reduce the current power demand, wherein the reduction of the flow rates of the one or more fluid pumps achieves a minimum reduction of the current power demand that avoids the impending power failure.

10. The method of claim 9, wherein the at least one power source includes at least one active power source and at least one inactive power source, and wherein the method further comprises:

causing, based on the current power demand corresponding to the available power supply, activation of the at least one inactive power source to increase the available power supply.

11. The method of claim 9, wherein a plurality of fluid pumps includes the one or more fluid pumps, wherein the plurality of fluid pumps are associated with respective machine hour values, and wherein the method further comprises:

selecting the one or more fluid pumps from the plurality of fluid pumps based on the respective machine hour values.

12. The method of claim 9, wherein the reduction of the flow rates of the one or more fluid pumps is caused in accordance with respective load distribution settings for the one or more fluid pumps.

13. The method of claim 9, wherein the flow rates of the one or more fluid pumps are reduced in a particular sequence.

14. A controller, comprising:

one or more memories; and one or more processors configured to:

monitor a current power demand of a hydraulic fracturing system; and control, in accordance with achieving a minimum reduction of the current power demand that avoids power failure, flow rates of one or more fluid pumps of the hydraulic fracturing system.

15. The controller of claim 14, wherein the one or more processors are further configured to:

cause activation of at least one inactive power source to increase available power supply.

16. The controller of claim 15, wherein the one or more processors are further configured to:

cause increasing of the flow rates of the one or more fluid pumps based on the activation of the at least one inactive power source.

17. The controller of claim 14, wherein the one or more processors, to control the flow rates of the one or more fluid pumps, are configured to:

cause reductions to speeds of motors that respectively drive the one or more fluid pumps.

18. The controller of claim 17, wherein the reductions of the speeds of the motors is caused via variable frequency drives that respectively control the motors.

19. The controller of claim 14, wherein the one or more processors are further configured to:

monitor whether at least one power source is active or inactive, and wherein the flow rates are controlled further based on whether the at least one power source is active or inactive.

20. The controller of claim 14, wherein the one or more processors are further configured to:

determine an adjustment that achieves the minimum reduction of the current power demand that avoids the power failure based on one or more of:

a power difference between the current power demand and an available power supply of at least one power source for the hydraulic fracturing system, a pressure of the hydraulic fracturing system, a configuration of a pump system that includes the one or more fluid pumps, or a configuration of the hydraulic fracturing system.

* * * * *